US007733076B1

(12) United States Patent
Shirvani-Mahdavi et al.

(10) Patent No.: US 7,733,076 B1
(45) Date of Patent: Jun. 8, 2010

(54) DUAL REFERENCE CURRENT GENERATION USING A SINGLE EXTERNAL REFERENCE RESISTOR

(75) Inventors: Alireza Shirvani-Mahdavi, San Jose, CA (US); George Chien, Cupertino, CA (US); Yuan-Ju Chao, Cupertino, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 11/028,990

(22) Filed: Jan. 3, 2005

Related U.S. Application Data

(60) Provisional application No. 60/534,863, filed on Jan. 8, 2004.

(51) Int. Cl.
*G05F 3/26* (2006.01)

(52) U.S. Cl. ..... 323/315; 323/312; 323/316

(58) Field of Classification Search ..... 323/315, 323/316, 317, 312; 327/539
See application file for complete search history.

(56) References Cited

U.S. PATENT DOCUMENTS 5,448,158 A * 9/1995 Ryat ..... 323/315
5,663,674 A * 9/1997 Beyer et al. ..... 327/540
5,774,013 A * 6/1998 Groe ..... 327/543
6,078,208 A * 6/2000 Nolan et al. ..... 327/512
6,340,882 B1 * 1/2002 Chung et al. ..... 323/315
6,381,491 B1 * 4/2002 Maile et al. ..... 607/2
6,628,558 B2 * 9/2003 Fiscus ..... 365/222
6,747,508 B2 * 6/2004 Liu et al. ..... 327/543
6,819,093 B1 * 11/2004 Kay ..... 323/315
6,982,590 B2 * 1/2006 Seshita ..... 327/539
7,012,415 B2 * 3/2006 Moraveji ..... 323/315
7,075,281 B1 * 7/2006 Pettersen ..... 323/312
2002/0196692 A1 * 12/2002 Fiscus ..... 365/222

* cited by examiner

*Primary Examiner*—Harry Behm

(57) ABSTRACT

Circuits and methods are provided for generating reference currents. In one implementation, a circuit is provided that includes a first source and a current control circuit in communication with the first source. The first source generates a first reference current that is a ratio of a first reference voltage and an external resistance. The current control circuit produces a second reference current that is a ratio of a second reference voltage and the external resistance. The current control circuit produces the second reference current without being directly coupled to the external resistance.

26 Claims, 5 Drawing Sheets

DUAL REFERENCE CURRENT GENERATION USING A SINGLE EXTERNAL REFERENCE RESISTOR

CROSS-REFERENCE TO RELATED APPLICATIONS

The present application claims priority to U.S. Provisional Patent Application No. 60/534,863, filed on Jan. 8, 2004, which is incorporated herein by reference in its entirety. The present application is related to U.S. application Ser. No. 11/029,194, filed Jan. 3, 2005, entitled "VARIABLE GAIN AMPLIFICATION USING TAYLOR EXPANSION", now issued as U.S. Pat. No. 7,199,661, the contents of which is incorporated herein by reference.

BACKGROUND

The following disclosure generally relates to electrical circuits and signal processing.

Conventional solid-state integrated circuits make use of reference voltage and reference current generation circuits for various purposes, for example, to provide dc biasing. Integrated circuits associated with applications having low tolerances to variations of a reference voltage or a reference current typically include accurate off-chip passive components for reference generation.

One type of reference voltage generation circuit is a bandgap circuit. A bandgap circuit typically generates a constant bandgap voltage ($V_{BG}$) that is insensitive to conditions of an integrated circuit such as temperature, chip supply voltage, and fabrication process variations. Another type of reference voltage generation circuit is a proportional-to-absolute-temperature reference (PTAT) circuit. In contrast to a bandgap circuit, a PTAT circuit generates a PTAT voltage ($V_{PTAT}$) that has a linear dependence on temperature (i.e., $V_{PTAT}$=kT, where T represents absolute temperature (in Kelvin) and k represents a temperature insensitive constant). Since a transconductance ($g_m$) of transistors (e.g., bipolar junction transistors) typically changes linearly with respect to temperature, some integrated circuits may need a current (i.e., $I_{PTAT}$), proportional to voltage $V_{PTAT}$, to bias one or more transistors in a manner that maintains a fixed transconductance for the transistors.

With respect to reference current generation circuits, process variations between integrated circuits typically prevent conventional integrated circuits from internally generating a sufficiently accurate reference current. For example, an internal reference current derived from an internal resistor ($R_{CHIP}$) within one integrated circuit (e.g., $V_{PTAT}/R_{CHIP}$) may vary by ±15% or more relative to an internal reference current derived from an internal resistance RCHIP within a different integrated circuit having an exact same configuration. Such variations are not suitable for many high-precision, high-speed and high-bandwidth applications.

An integrated circuit requiring an accurate reference current can be produced using a reference voltage (e.g., $V_{PTAT}$ or $V_{BG}$) and an external, more accurate resistance ($R_{EXT}$). Such a reference current requires a separate terminal connection and an additional external resistor. Additional terminals and resistors are generally expensive (i.e., terminals on an integrated circuit are an expense and require additional manufacturing cost to produce and, similarly, additional external components add to the cost of a given circuit with attending cost increases due to mounting and coupling the external component). Further, terminals also consume valuable die area and increase package size (i.e., unnecessary terminals waste valuable resource space).

FIG. 1 is a schematic diagram illustrating a conventional current generation circuit 100 including an integrated circuit 110. Integrated circuit 110 includes an external resistance $R_{EXT1}$ 130 in communication with a source 132 through a terminal 131. Source 132 produces a first reference current ($I_{REF1}$). Integrated circuit 110 also includes an external resistance $R_{EXT2}$ 120 in communication with a source 122 through a terminal 121. Source 122 produces a second reference current ($I_{REF2}$). The first and second reference currents $I_{REF1}$, $I_{REF2}$ can supply constant currents to various components on integrated circuit 110 such as circuit components 111*a* and 111*b*, respectively.

SUMMARY

This disclosure generally describes a current generation circuit and a method of current generation. In general, in one aspect, the current generation circuit includes: a first source to generate a first reference current that is a ratio of a first reference voltage and an external resistance; and a current control circuit in communication with the first source, the current control circuit configured to control a second reference current that is a ratio of a second reference voltage and the external resistance, the current control circuit configured to control the second reference current without a source of the second reference current being directly coupled to the external resistance.

Particular implementations can include one or more of the following features. The current control circuit of can be configured to receive the second reference current. The current generation circuit can further comprise a second source, coupled to the second reference current and sourcing a current that is proportional to the second reference current. The current generation circuit can further comprise a closed voltage loop to control the second reference current in conjunction with one or more internal resistances such that the second reference current is substantially unaffected by an accuracy level of the one or more internal resistances. The current generation circuit can be configured to produce the second reference current such that the second reference current is substantially unaffected by one or more conditions associated with the circuit. The one or more conditions can include at least one of temperature, process variation, and voltage supply level. The current generation circuit can include the first reference voltage provided by a substantially constant voltage source. The current generation circuit can include the second reference voltage provided by a proportional-to-absolute-temperature voltage ($V_{PTAT}$) source that remains substantially constant except for a linear dependence on a temperature of the circuit. The external resistance can include an external resistor having a predetermined accuracy level.

In general, in another aspect, the current generation circuit includes: an external resistance; a first source to generate a first reference current that is a ratio of a first reference voltage and the external resistance; a second source to generate a second reference current that is a ratio of a second reference voltage and the external resistance; a third source to generate a first internal reference current that is a ratio of the first reference voltage and a first internal resistance; a fourth source to generate a second internal reference current that is a ratio of the second reference voltage and a second internal resistance having a value substantially similar to a value of the first internal resistance; and a current control circuit operable to control the second reference current including substantially equating a proportional relationship between the first and second reference currents and the second and first internal reference currents.

In general, in another aspect, the method of current generation comprises: generating a first reference current that is a ratio of a first reference voltage and an external resistance; and generating a second reference current that is a ratio of a second reference voltage and the external resistance without directly coupling to the external resistance.

Particular implementations may include one or more of the following features. The method can further comprise receiving the second reference current. The method can further comprise sourcing a current that is proportional to the second reference current. Generating the second reference current can comprise controlling the second reference current in conjunction with one or more internal resistances such that the second reference current is substantially unaffected by an accuracy level of the one or more internal resistances. Generating the second reference current can comprise producing the second reference current such that the second reference current is substantially unaffected by one or more conditions associated with the circuit. The one or more conditions can include at least one of temperature, process variation, and voltage supply level. The first reference voltage can be a substantially constant voltage. The second reference voltage can remain substantially constant except for a linear dependence on a temperature of the circuit. The external resistance can include an external resistor having a predetermined accuracy level.

In general, in another aspect, the method of current generation can comprise: generating a first reference current that is a ratio of a first reference voltage and an external resistance; generating a second reference current that is a ratio of a second reference voltage and the external resistance; generating a first internal reference current that is a ratio of the first reference voltage and a first internal resistance; generating a second internal reference current that is a ratio of the second reference voltage and a second internal resistance having a value substantially similar to a value the first internal resistance; and controlling the second reference current including substantially equating a proportional relationship between the first and second reference currents and the second and first internal reference currents.

In general, in another aspect, the current generation circuit comprises: means for generating a first reference current that is a ratio of a first reference voltage and an external resistance; means, in communication with the means for generating, for controlling a second reference current that is a ratio of a second reference voltage and the external resistance, the means for controlling operable to control the second reference current without a source of the second reference current being directly coupled to the external resistance.

Aspects of the invention can provide one or more of the following advantages. The circuit can generate two accurate reference currents based on a single external reference, thereby saving expense from additional terminals and resistors, and consumption of valuable die area. Furthermore, a reference current can be produced that, when biased by a temperature dependent voltage source such as reference voltage $V_{PTAT}$, yields a fixed transconductance in bipolar junction transistors (BJTs) in a circuit.

DETAILED DESCRIPTION

Figure 1:
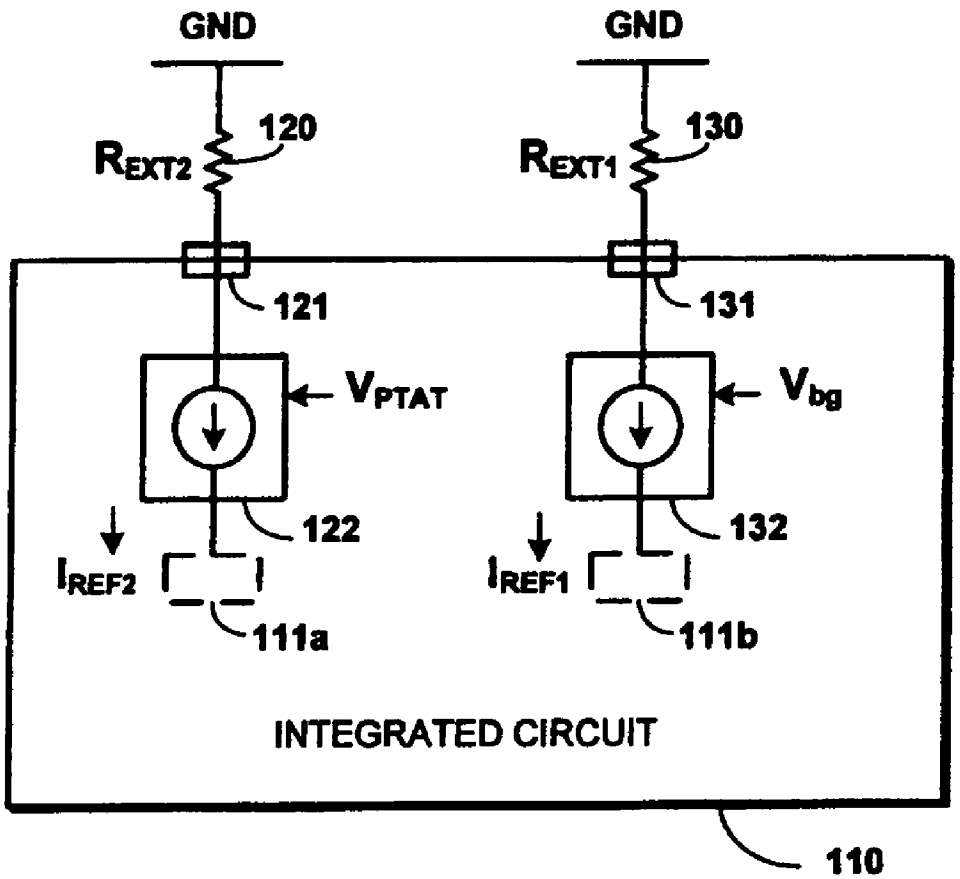
FIG. 1 (PRIOR ART)
FIG. 1 is a schematic diagram illustrating a conventional current generation circuit.
Figure 2:
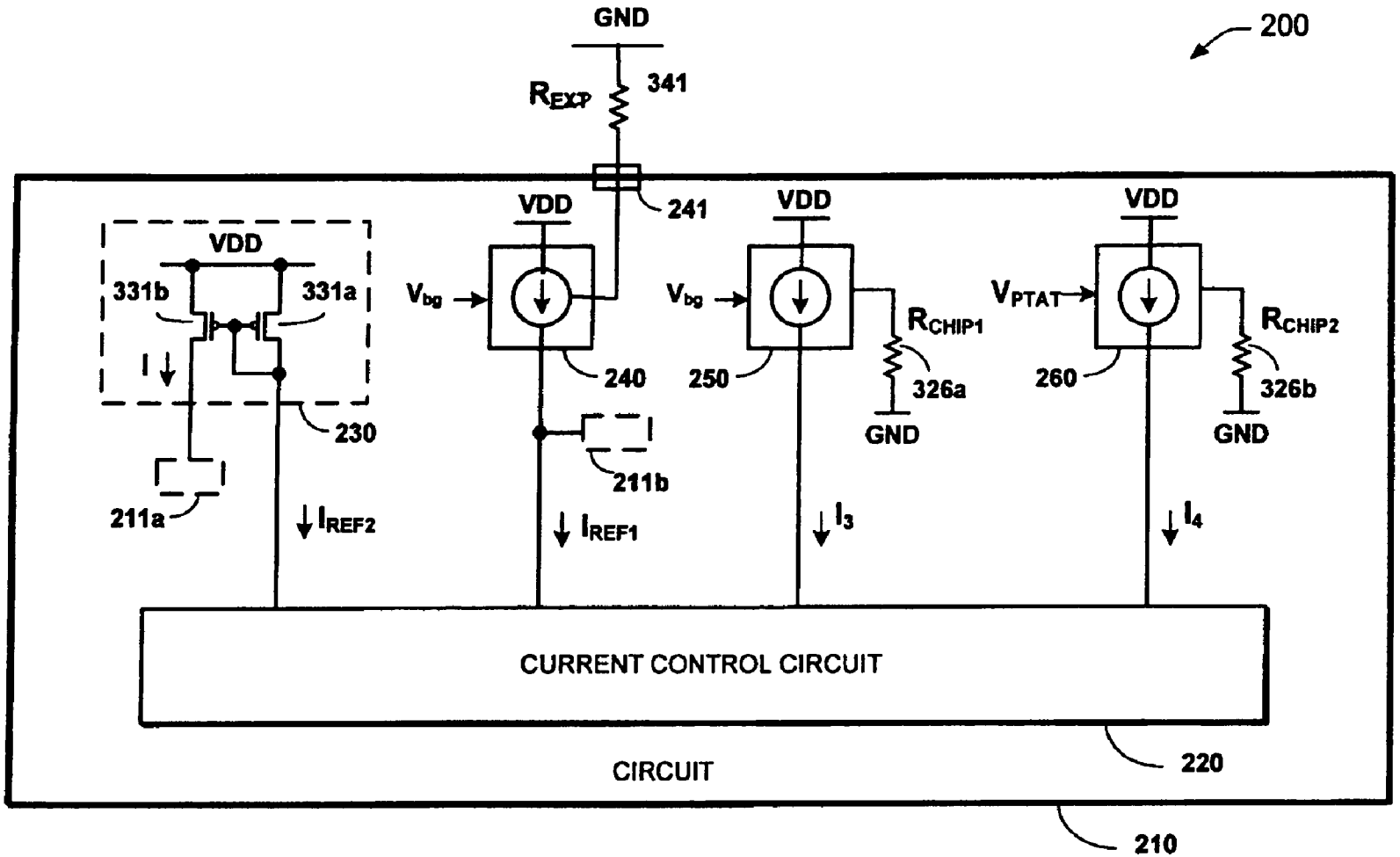
FIG. 2 is a schematic diagram of a current generation circuit.

FIG. 2 is a schematic diagram of a current generation circuit 200 including a circuit 210, an external resistance $R_{EXT}$ 341 and an input 241. Circuit 210 is in communication with external resistance $R_{EXT}$ 341 through input 241.

Circuit 210 can be (or included in), for example, a semiconductor device or integrated circuit formed from silicon, gallium arsenide, and the like. External resistance $R_{EXT}$ 341 can be, for example, a resistor with a predetermined level of accuracy (i.e. a low error tolerance). Input 241 can be a terminal, a chip interface, or any other signal input device. At a high level, circuit 210 generates a first reference current ($I_{REF1}$) and a second reference current ($I_{IREF2}$). Both currents $I_{REF1}$ and $I_{REF2}$ are related to external resistance $R_{EXT}$ 341 even though current $I_{REF2}$ is not directly coupled to external resistance $R_{EXT}$ 341.

In one implementation, circuit 210 includes a current control circuit 220, sources 230, 240, 250 and 260, internal resistors $R_{CHIP1}$ 326*a* and $R_{CHIP2}$ 326*b*, and circuit components 211*a, b*.

Figure 4:
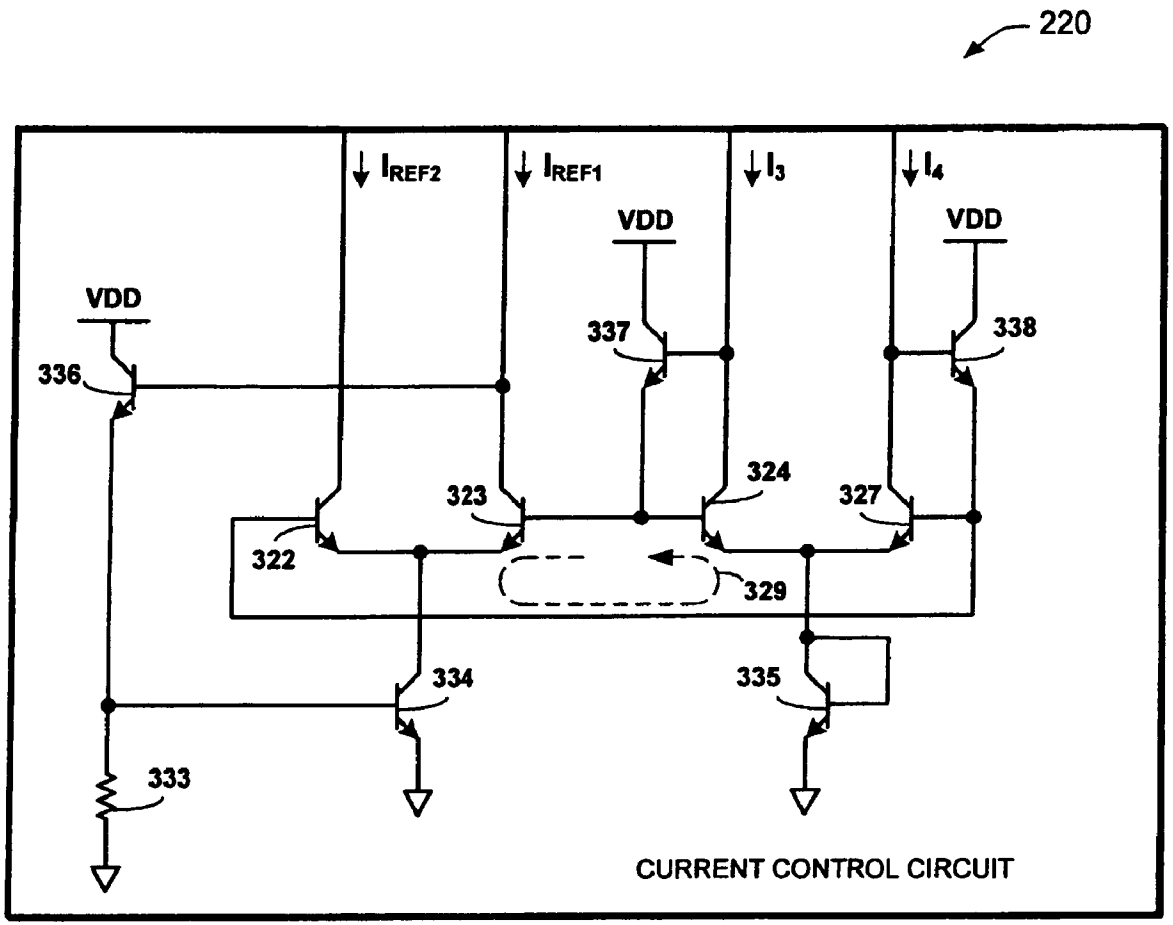
FIG. 4 is a schematic diagram of a current control circuit.

Current control circuit 220 can be implemented using, for example, bipolar junction transistors (BJTs) as shown in FIG. 4, metal oxide semiconductor field effect transistors (MOSFETs), other types of transistors, and the like. In addition, current control circuit 220 can be integrated on a common substrate with sources 230, 240, 250 and 260, but in some implementations can be located externally. Current control circuit 220 is in communication with sources 230, 240, 250 and 260. The details of one implementation of current control circuit 220 are discussed below in relation to FIG. 4.

In the implementation shown, source 230 includes a current mirror comprising transistors 331*a,b*. Transistors 331*a,b* are coupled to a supply voltage $V_{DD}$. Transistor 331*b* produces (i.e., sources) a current I that is provided to circuit components 211*a*. Current I mirrors—i.e., is controlled by—current $I_{REF2}$, and, as will be described below, is equal to a ratio of a varying reference voltage $V_{PTAT}$ and the external resistance $R_{EXT}$ 341 (i.e., $I=V_{PTAT}/R_{EXT}$). Current I, based on varying voltage $V_{PTAT}$, can produce a constant transconductance in a transistor having temperature varying properties as discussed in more detail below. In one implementation, transistors 331*a,b* are equally sized and accordingly, current $I=I_{REF2}$. Source 230 generates a substantially constant reference current value for current $I_{REF2}$ related to the external resistance $R_{EXT}$ 341.

In an alternative implementation, source 230 is not required. In this implementation, rather than providing a current source (i.e., source 230), current control circuit 220 sinks an amount of current ($I_{REF2}$) that is controlled as discussed below.

Figure 3A:
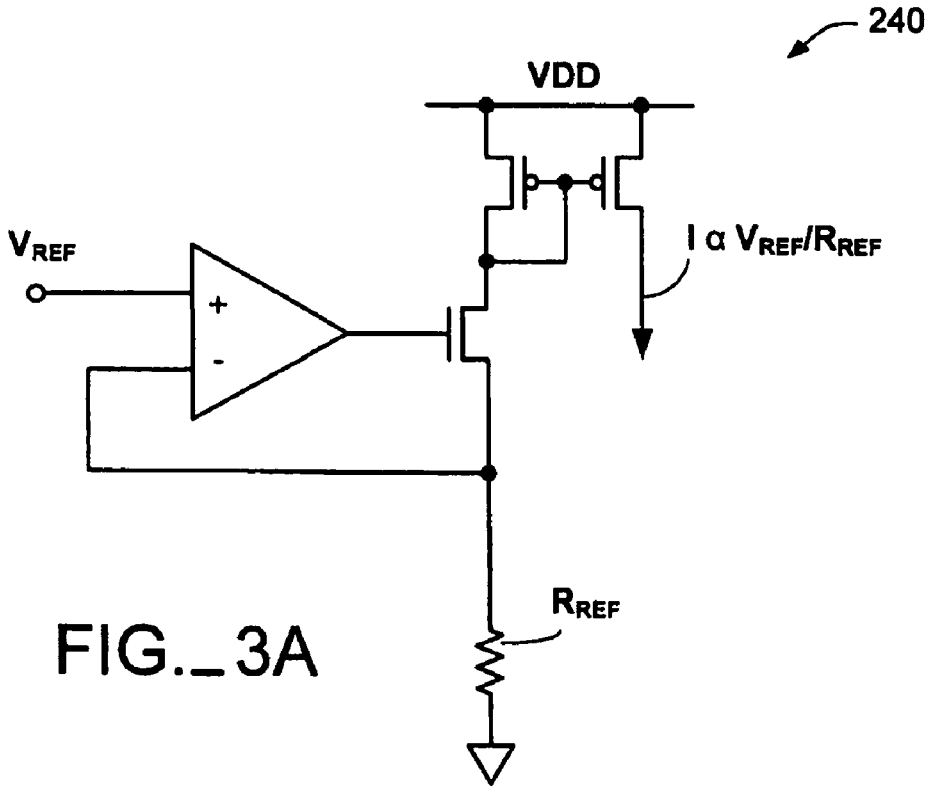
FIGS. 3A and 3B are schematic diagrams of a source.
Figure 3B:
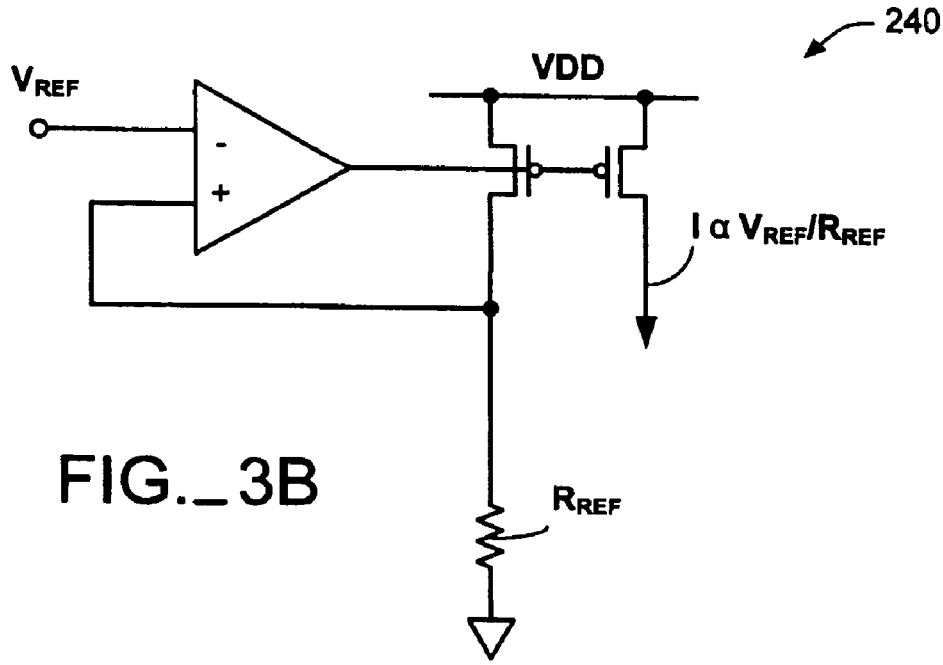

In one implementation, source 240 is a device that includes two inputs, and an output (as summarized below in Table 1) and is coupled to a supply voltage $V_{DD}$. FIGS. 3A and 3B illustrate two example implementations of source 240. Sources 250, 260 can have a similar construction as source 240 with inputs and outputs as summarized in Table 1.

TABLE 1

| FIG. 3A or FIG. 3B | SOURCE 240 | SOURCE 250 | SOURCE 260 |
|---|---|---|---|
| $V_{REF}$ | $V_{BG}$ | $V_{BG}$ | $V_{PTAT}$ |
| $R_{REF}$ | $R_{EXT}$ | $R_{CHIP1}$ | $R_{CHIP2}$ |

As shown in FIG. 2, the output of source 240 provides a reference current $I_{REF1}$ that can be coupled to both current control circuit 220 and circuit components 211*b*. Source 240 operates to provide at its output a reference current $I_{REF1}$ that is defined by a ratio of the constant reference voltage and the external resistance ($I_{REF1}=V_{BG}/R_{EXT}$). Reference current $I_{REF1}$ can be provided as an accurate bias current to circuit components 211*b*. In one implementation the reference current $I_{Ref1}$ is not drawn from the constant reference voltage (i.e., bandgap voltage $V_{BG}$) directly, rather is merely proportional to it and inversely proportional to the external resistance $R_{EXT}$. Source 240 generates a substantially constant current value for current $I_{REF1}$ using external resistance $R_{EXT}$ 341 which has a predefined accuracy tolerance.

Source 250 can be a device that includes a nominally constant reference voltage $V_{BG}$ as an input as described above with respect to Table 1. Source 250 is coupled to a resistor $R_{CHIP1}$ 326*a* which is also coupled to a reference voltage (preferably ground). The output of source 250 is coupled to current control circuit 220 and may be coupled to other components requiring a constant reference source (not shown). Source 250 operates to provide at its output a reference current $I_3$ that is defined by a ratio of the constant reference voltage and the internal resistance ($I_3=V_{BG}/R_{CHIP1}$).

Source 260 can include a varying reference voltage, proportional-to-absolute-temperature voltage ($V_{PTAT}$), which varies with temperature as an input. Source 260 is coupled to an internal resistor $R_{CHIP2}$ 326*b* which is also coupled to a reference voltage (preferably ground). The output of source 260 is coupled to current control circuit 220 and may be coupled to other components requiring a varying reference source (not shown). Source 260 operates to provide a reference current $I_4$ that is defined by a ratio of the varying reference voltage and the internal resistance ($I_4=V_{PTAT}/R_{CHIP2}$). Contrary to a dependence on the external resistance $R_{EXT}$ 341 by sources 230 and 240, sources 250 and 260 generate potentially varying values for currents $I_3$ and $I_4$ by using internal resistors $R_{CHIP1}$ 326*a* and $R_{CHIP2}$ 326*b*. In one implementation, both currents $I_3$ and $I_4$ depend on the same type of internal resistor (i.e., same type, size and layout).

Internal resistors $R_{CHIP1}$ 326*a* and $R_{CHIP2}$ 326*b* can be, for example, resistors without a predetermined level of accuracy (i.e., a high error tolerance). Preferably internal resistance $R_{CHIP1}$ 326*a* matches (e.g., by being cast from the same die), or is substantially similar to, internal resistance $R_{CHIP2}$ 326*b*.

Current control circuit 220 has inputs to receive currents $I_{REF1}$, $I_{REF2}$, $I_3$ and $I_4$. Current control circuit 220 controls current $I_{REF2}$ in accordance with fixed ratios established for the currents $I_{REF1}$ and $I_{REF2}$, and the currents $I_3$ and $I_4$. In one implementation, the proportional relationship of reference currents $I_{REF1}/I_{REF2}$ is equivalent to the proportional relationship of reference currents $I_4/I_3$. The proportional relationships can be realized through a variety of circuit configurations, such as a translinear circuit discussed below with respect to FIG. 4.

FIG. 4 is a more detailed schematic of one implementation of a current control circuit 220. In the implementation shown, current control circuit 220 is a translinear circuit that includes a closed voltage loop 329 and supporting electronic components.

Closed voltage loop 329 includes BJTs 322-324, and 327. A base of BJT 323 is in communication with a base of BJT 324, a base of BJT 322 is in communication with a base of BJT 327, an emitter of BJT 322 is in communication with an emitter of BJT 323, and an emitter of BJT 324 is in communication with an emitter of 327. A collector of BJT 323 receives current $I_{REF1}$, a collector of BJT 322 receives current $I_{REF2}$, a collector of BJT 324 receives current $I_3$, and a collector of BJT 327 receives current $I_4$.

Current control circuit 220 includes a number of additional components specific to the implementation. These components include BJTs 334-338 and resistor 333.

Closed voltage loop 329 controls current $I_{REF2}$ in accordance with the proportions discussed above. To implement the proportional relationships, BJTs 322-324, and 327 are biased into the active region. BJTs 337, 338 are commonly referred to as beta boosters that provide base current to BJTs 322, 323, 324 and 327 (providing base current to the four transistors so that the base currents are not subtracted from the respective reference currents which could cause inaccuracies in the closed voltage loop). BJTs 337, 338 also serve to keep BJTs 324 and 327 in the active region. A feedback loop, including BJTs 334, 336 and resistor 333 biases BJT 323 into the active region. More particularly, BJTs 334 and 336 ensure that the collector voltage of BJT 323 stays above the saturation voltage for the device. BJT 335 provides a common mode DC bias for the circuit.

The relationship of closed voltage loop 329 is derived as follows:

$$V_{BE322}-V_{BE323}+V_{BE324}-V_{BE327}=0 \tag{1}$$

$$V_T\ln\frac{I_{REF2}}{I_{S2}}-V_T\ln\frac{I_{REF1}}{I_{S1}}+V_T\ln\frac{I_3}{I_{S3}}-V_T\ln\frac{I_4}{I_{S4}}=0 \tag{2}$$

$$\text{Assuming } I_{S1}=I_{S2} \text{ and } I_{S3}=I_{S4},\quad \frac{I_{REF1}}{I_{REF2}}=\frac{I_4}{I_3} \tag{3}$$

Equation (1) results from applying Kirchhoff's voltage law to base-emitter voltages ($V_{BE}$s of the respective transistors) around closed loop 329. Equation (2) expresses $V_{BE}$s in terms of the subject collector currents (i.e., currents $I_{REF1}$, $I_{REF2}$, $I_3$, and $I_4$) along with thermal voltages ($V_T$s) and saturation currents ($I_S$s). Assuming that BJT 322 matches BJT 323, and that BJT 324 matches BJT 327, $I_S$1=$I_S$2 and $I_S$3=$I_S$4. Accordingly, equation (2) reduces to an expression of currents in equation (3). Since currents $I_{REF1}$, $I_3$ and $I_4$ are available from sources 240, 250 and 260 (as shown in FIG. 4), current control circuit 220 is configured to control current $I_{REF2}$ (FIG. 4) using the relationship of equation (3).

More particularly, current control circuit 220 is also able to generate current $I_{REF2}$ in a manner such that current $I_{REF2}$ is substantially unaffected by inaccuracies in physical properties of internal resistors $R_{CHIP1}$ 326*a* and $R_{CHIP2}$ 326*b*, such as temperature, supply voltage, or process variation (providing that the two resistors $R_{CHIP1}$ 326*a* and $R_{CHIP2}$ 326*b* have matching layouts, and hence, vary together). Variations are cancelled as illustrated in the following equations:

$$\frac{I_{REF1}}{I_{REF2}} = \frac{I_4}{I_3} \tag{3}$$

$$\frac{\frac{V_{bg}}{R_{EXT}}}{\frac{V_{PTAT}}{R_{EXT}}} = \frac{\frac{V_{bg}}{R_{CHIP2}}}{\frac{V_{PTAT}}{R_{CHIP1}}} \tag{4}$$

$$\frac{V_{bg}}{V_{PTAT}} = \frac{V_{bg}}{V_{PTAT}} \tag{5}$$

Equation (4) expresses the subject currents in terms of biasing voltages (i.e., $V_{BG}$ and $V_{PTAT}$) and associated resistors (i.e., $R_{EXT}$, $R_{CHIP1}$ and $R_{CHIP2}$). As discussed above, since that internal resistance $R_{CHIP1}$ 326*a* matches internal resistance $R_{CHIP2}$ 326*b* (although the absolute values can be inaccurate relative to an absolute value), variations between the resistors cancel out of the denominators, yielding the equality of equation (5). Therefore, current control circuit 220 can generate (i.e., sink, in the configuration shown) a temperature varying current $I_{REF2}$ (and source a corresponding current I) from voltage $V_{PTAT}$ based on a constant, temperature independent current $I_{REF1}$ generated from voltage $V_{BG}$.

Advantageously, current control circuit 220 can produce a fixed transconductance ($g_m$) in circuit component 211*a* including a BJT. Because current $I_{REF2}$ is associated with voltage $V_{PTAT}$, temperature variations affecting voltage $V_{PTAT}$ similarly affect transconductance $g_m$. Transconductance $g_m$ relates to voltage $V_{PTAT}$ as follows:

$$g_m = \frac{I_C}{V_T} = \frac{I_{REF2}}{\frac{kT}{q}} = \frac{\frac{V_{PTAT}}{R_{EXT}}}{\frac{kT}{q}} = \frac{\frac{\alpha T}{R_{EXT}}}{\frac{kT}{q}} = \frac{\alpha q}{kR_{EXT}} \tag{6}$$

Equation (6) expresses transconductance $g_m$ in terms of collector current $I_c$ (or current $I_{REF2}$ in FIG. 4) and voltage $V_{PTAT}$. In turn, current $I_{REF2}$ and voltage $V_{PTAT}$ are expressed in terms of temperature T. After canceling temperature T and other common terms, transconductance gm is expressed as a function of the reliable, external resistance $R_{EXT}$ 341 rather than internal resistance $R_{CHIP1}$ 326*a* or internal resistance $R_{CHIP2}$ 326*b* (noting that α and k are constants).

Current control circuit 220 can also produce a fixed gain (Av) in circuit component 211*a* including a power amplifier (e.g., an inductively loaded RF amplifier, mixer, low noise amplifier, or open collector drive amplifier) where the load $R_L$ is constant. Gain Av relates to transconductance $g_m$ of equation (6) as follows:

$$Av = g_m \times R_L = \frac{\alpha R_L}{R_{EXT}} \tag{7}$$

Equation (7) expresses gain Av in terms of the reliable, external resistance $R_{EXT}$ 341. As a result, current control circuit 220 is able to maintain a substantially constant gain Av drawn from varying voltage $V_{PTAT}$.

The proportional relationships and sustaining thereof can be realized through a variety of circuit configurations, such as the translinear circuit discussed above. Any circuit that produces the described relationships can be substituted for closed voltage loop 329. Current control circuit 220 can be implemented using for example, BJTs, metal oxide semiconductor field effect transistors (MOSFETs) digital circuit components and the like. In addition, current control circuit 220 can be located within a same integrated circuit as circuit 210, or alternatively, off chip.

Figure 5:
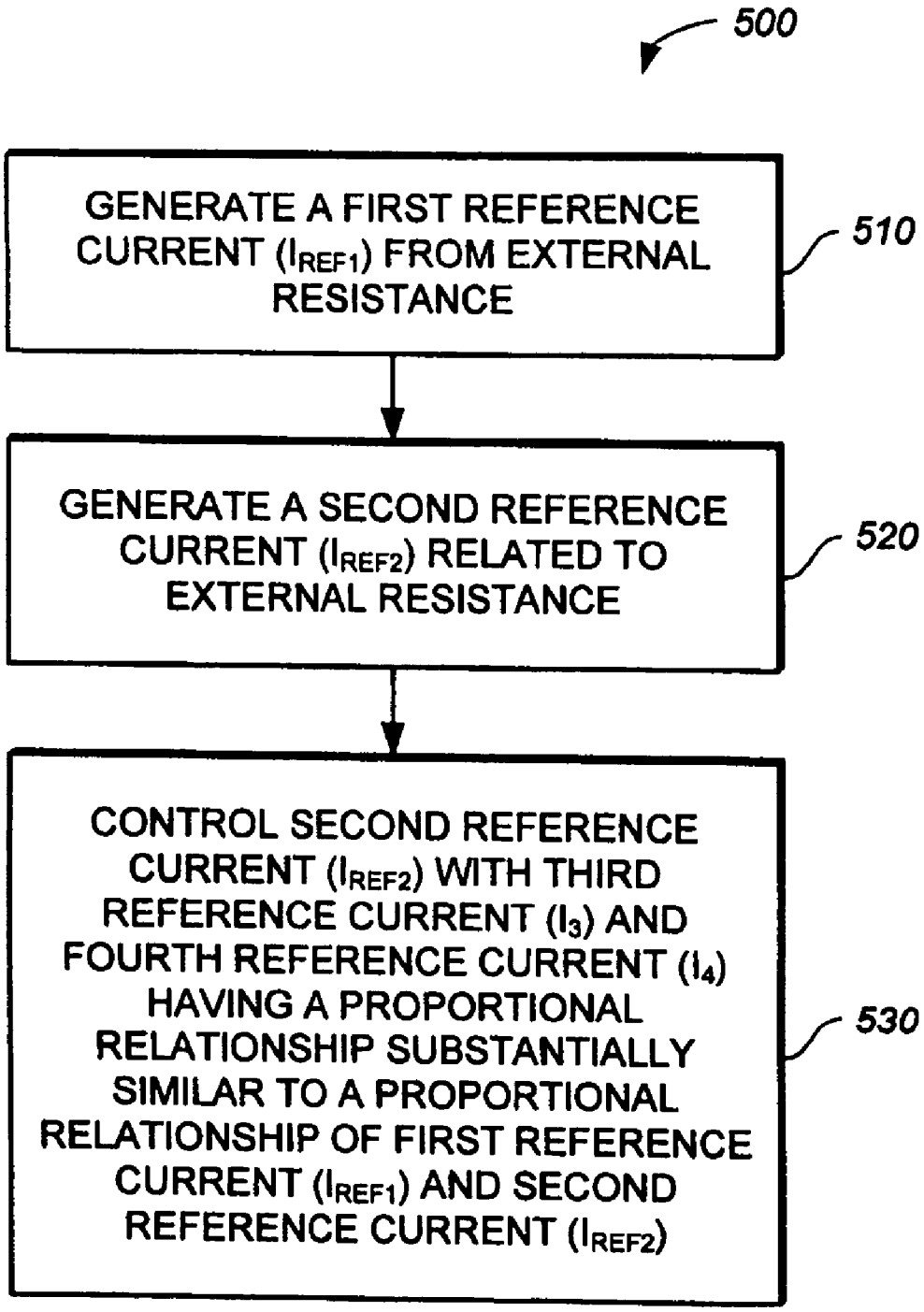
FIG. 5 is a flow chart illustrating a method for generating reference currents.

FIG. 5 is a flow chart of a method 500 for generating reference currents. A source (e.g., source 240) generates 510 a first reference current (e.g., current $I_{REF1}$) from an external resistance (e.g., external resistance $R_{EXT}$ 341) and a first reference voltage (e.g., voltage $V_{BG}$). A circuit (e.g., circuit 210) generates 520 a second reference current (e.g., current $I_{REF2}$) related to the external resistance, and a second reference voltage (e.g., voltage $V_{PTAT}$). A controller (e.g., current control circuit 220) controls 530 the second reference current with the first reference current, a third reference current (e.g., current $I_3$) and a fourth reference current (e.g., current $I_4$). The fourth and the third reference currents are configured to have a proportional relationship substantially similar to a ratio of the first and second reference currents (e.g., $I_{REF1}/I_{REF2} = I_4/I_3$).

A number of implementations have been described. Nevertheless, it will be understood that various modifications may be made without departing from the spirit and scope of the invention. For example, though one aspect of the invention has been described as controlling a particular reference current (i.e., $I_{REF2}$), the circuits and principles disclosed can be used to control any of the reference currents ($I_{REF1}$, $I_3$, or $I_4$) when the corresponding other three currents are available (e.g., a current loop included in a current control circuit can be used to control current $I_{REF1}$, when $I_{REF2}$, $I_3$ and $I_4$ are available). Accordingly, other implementations are within the scope of the following claims.

What is claimed is:

1. An integrated circuit configured to couple with a resistance element that is external to the integrated circuit, the integrated circuit comprising:

a first source to generate a first reference current that is a ratio of a first reference voltage and a resistance corresponding to the resistance element, wherein the resistance element is external to the integrated circuit;

a second source to generate a second, different, reference current, wherein a value of the first reference current differs from a value of the second reference current; and a current control circuit in communication with the first source and the second source, the current control circuit configured to control the second reference current, wherein the value of the second reference current is related to a ratio of a second reference voltage and the resistance, wherein the current control circuit is configured to control the second reference current without the second source or the current control circuit being directly coupled to the resistance element, wherein the current control circuit is configured to receive the first reference current and the second reference current.

2. The circuit of claim 1, further comprising a source, coupled to the second reference current and sourcing a current that is proportional to the second reference current.

3. The circuit of claim 1, further comprising:

one or more resistance elements, wherein the current control circuit further comprises:

a closed voltage loop to control the second reference current in conjunction with the one or more resistance elements such that the second reference current is substantially unaffected by an accuracy level of the one or more resistance elements.

4. The circuit of claim 1, wherein the current control circuit is configured to produce the second reference current such that the second reference current is substantially unaffected by one or more conditions associated with the circuit.

5. The circuit of claim 4, wherein the one or more conditions include at least one of temperature, process variation, and voltage supply level.

6. The circuit of claim 1, wherein the first reference voltage is provided by a substantially constant voltage source.

7. The circuit of claim 1, wherein the second reference voltage is provided by a proportional-to-absolute-temperature voltage ($V_{PTAT}$) source that remains substantially constant except for a linear dependence on a temperature of the circuit.

8. The circuit of claim 1, wherein the resistance element includes a resistor having a predetermined accuracy level.

9. A method, comprising:

generating, within an integrated circuit, a first reference current that is a ratio of a first reference voltage and a resistance corresponding to a resistance element, wherein the resistance element is external to the integrated circuit;

generating a second, different, reference current without directly coupling to the resistance element, wherein a value of the first reference current differs from a value of the second reference current; and controlling the second reference current responsive to a ratio of a second reference voltage and the resistance without directly coupling to the resistance element, wherein the controlling includes: receiving the first and second reference currents, and controlling the second reference current responsive to the ratio, the first reference current, and the second reference current.

10. The method of claim 9, further comprising:

sourcing a current that is proportional to the second reference current.

11. The method of claim 9, wherein the controlling the second reference current comprises:

controlling the second reference current in conjunction with one or more resistance elements such that the second reference current is substantially unaffected by an accuracy level of the one or more resistance elements, wherein the integrated circuit comprises the one or more resistance elements.

12. The method of claim 9, wherein the controlling the second reference current comprises:

producing the second reference current such that the second reference current is substantially unaffected by one or more conditions associated with the integrated circuit.

13. The method of claim 12, wherein the one or more conditions include at least one of temperature, process variation, and voltage supply level.

14. The method of claim 9, wherein the first reference voltage is a substantially constant voltage.

15. The method of claim 9, wherein the second reference voltage remains substantially constant except for a linear dependence on a temperature of the integrated circuit.

16. The method of claim 9, wherein the resistance element includes a resistor having a predetermined accuracy level.

17. An integrated circuit configured to couple with a resistance element that is external to the integrated circuit, the integrated circuit comprising:

means for generating a first reference current that is a ratio of a first reference voltage and a resistance corresponding to the resistance element, wherein the resistance element is external to the integrated circuit;

means for generating a second, different, reference current without directly coupling to the resistance element, wherein a value of the first reference current differs from a value of the second reference current; and means, in communication with the means for generating the first and second reference currents, for controlling the second reference current, wherein the value of the second reference current is related to a ratio of a second reference voltage and the resistance, wherein the means for controlling is operable to control the second reference current without being directly coupled to the resistance element, wherein the means for controlling the second reference current is configured to receive the first reference current and the second reference current.

18. The circuit of claim 17, further comprising means, coupled to the second reference current, for sourcing a current that is proportional to the second reference current.

19. The circuit of claim 17, further comprising:

one or more resistance elements, wherein the means for controlling further comprises:

a closed voltage loop to control the second reference current in conjunction with the one or more resistance elements such that the second reference current is substantially unaffected by an accuracy level of the one or more resistance elements.

20. The circuit of claim 17, wherein the means for controlling is configured to produce the second reference current such that the second reference current is substantially unaffected by one or more conditions associated with the circuit.

21. The circuit of claim 20, wherein the one or more conditions include at least one of temperature, process variation, and voltage supply level.

22. The circuit of claim 17, wherein the first reference voltage is provided by a substantially constant voltage source.

23. The circuit of claim 17, wherein the second reference voltage is provided by a proportional-to-absolute-temperature voltage ($V_{PTAT}$) source that remains substantially constant except for a linear dependence on a temperature of the circuit.

24. The circuit of claim 17, wherein the resistance element includes a resistor having a predetermined accuracy level.

25. The circuit of claim 1, wherein the current control circuit comprises the second source.

26. The circuit of claim 17, wherein the means for controlling comprises the means for generating the second different reference current.

* * * * *